US005749705A

United States Patent [19]

Clarke et al.

[11] Patent Number: 5,749,705

[45] Date of Patent: May 12, 1998

[54] RETENTION SYSTEM FOR BAR-TYPE DAMPER OF ROTOR BLADE

[75] Inventors: Jonathon P. Clarke, West Chester; Brian A. Norton, Cincinnati, both of Ohio

[73] Assignee: General Electric Company, Cincinnati, Ohio

[21] Appl. No.: 728,710

[22] Filed: Oct. 11, 1996

[51] Int. Cl.[6] ..... F01D 5/26

[52] U.S. Cl. ..... 416/190; 416/193 A; 416/248; 416/500

[58] Field of Search ..... 416/144, 145, 416/190, 193 A, 248, 500, 219 R, 220 R

[56] References Cited

U.S. PATENT DOCUMENTS

| | | | |
|---|---|---|---|
| 3,266,770 | 8/1966 | Harlow | 416/190 |
| 4,516,910 | 5/1985 | Bouiller et al. | 416/190 |
| 5,215,442 | 6/1993 | Steckle et al. . | |
| 5,226,784 | 7/1993 | Mueller et al. | 416/248 |
| 5,261,790 | 11/1993 | Dietz et al. . | |
| 5,302,085 | 4/1994 | Dietz et al. . | |
| 5,369,882 | 12/1994 | Dietz et al. . | |

*Primary Examiner*—Christopher Verdier
*Attorney, Agent, or Firm*—Andrew C. Hess; Wayne O. Traynham

[57] ABSTRACT

A rotor blade for a rotor of a gas turbine engine having an axis of rotation including a root portion, a platform portion connected to the root portion and having a damper pocket formed therein, an airfoil portion connected to the platform portion, a generally bar-shaped damping member loosely arranged in the damper pocket having at least one scrubbing surface, and at least one retainer pin for retaining the bar-shaped damping member in the damper pocket. The bar-shaped damping member is slidably displaceable and rotatable within the damper pocket during rotation of the rotor. The damper pocket in the platform portion has a rear surface with an upper portion and a lower portion at an angle to the upper portion, a pair of spaced side surfaces, and a pair of spaced lower surfaces extending from the rear surface lower portion which are substantially coplanar. The damper pocket lower surfaces are provided by a first flange extending laterally inward from one of the side surfaces and a second flange extending laterally inward from the other side surface, where a retainer pin extends through and is connected to at least one of the first and second flanges so as to retain the bar-shaped damping member within the damper pocket.

12 Claims, 3 Drawing Sheets

RETENTION SYSTEM FOR BAR-TYPE DAMPER OF ROTOR BLADE

BACKGROUND OF THE INVENTION

1. Field of the Invention

The present invention relates generally to rotors of turbines and compressors in a gas turbine engine and, more particularly, to a means for retaining a bar type damper in turbine and compressor blades.

2. Description of Related Art

The rotor of a turbine or compressor in a gas turbine engine includes a plurality of blades which are circumferentially distributed on a disk for rotation therewith about the disk axis. A conventional rotor blade has a root or dovetail portion which is slidably received in a complementarily configured recess provided in the rotor disk, a platform portion located outside the rotor disk, an airfoil portion extending radially outwardly from the platform and in some cases a segmented shroud located at the tips of the airfoils, each shroud segment being connected to a corresponding blade tip.

The platforms of the rotor blades collectively define a radially outwardly facing wall and the tip shroud segments collectively define a radially inwardly facing wall of an annular gas flow passageway through the engine. The airfoils of the rotor blades extend radially into the passageway to interact aerodynamically with the gas flow therethrough. These airfoils are subject to vibrations which cause high cycle fatigue, so it is necessary to damp such vibrations to reduce the fatigue on the blades (particularly at or near resonant frequencies).

Various types of blade dampers are well known in the art. For example, one type of damper consists of certain wedge-shaped damping members being arranged in a corresponding wedge-shaped pocket formed in the root cavity of the blade and having two scrubbing surfaces. It is seen that this wedge-shaped damping member is retained in the pocket by means of a retainer pin in U.S. Pat. No. 5,302,085 and a hook-shaped metal clip in U.S. Pat. No. 5,261,790. While these wedge-shaped damping members are adequate in terms of providing a damping function, they do not function as seals between the platforms of adjacent blades.

Accordingly, a bar type damper for rotor blades has been developed which provides both the damping and sealing functions desired. In particular, the bar damper acts as an axial platform seal in turbine blades to reduce the ingestion of hot flowpath gases into the blade shank cavity region, which results in a reduction of disk post metal temperatures and an improvement in disk creep capability. It has been found, however, that the bar damper is not able to be utilized in certain applications because of the need to remove the rotor blades thereof during assembly and disassembly. This has led to the possibility of bar dampers falling out of the blade damper pocket and causing foreign object damage to the engine.

Accordingly, it would be desirable for a mechanism to be developed which retains a bar damper within a corresponding damper pocket of a rotor blade, whereby damping of vibrations experienced by the rotor blade and sealing between adjacent platforms of rotor blades may be accomplished without the risk of such bar dampers falling into the core of the engine during assembly or disassembly.

SUMMARY OF THE INVENTION

In accordance with one aspect of the present invention, a rotor blade for a rotor of a gas turbine engine having an axis of rotation is disclosed as including a root portion, a platform portion connected to the root portion and having a damper pocket formed therein, an airfoil portion connected to the platform portion, a generally bar-shaped damping member loosely arranged in the damper pocket having at least one scrubbing surface, and means for retaining the bar-shaped damping member in the damper pocket. The bar-shaped damping member is slidably displaceable and rotatable within the damper pocket during rotation of the rotor. The damper pocket in the platform portion has a rear surface with an upper portion and a lower portion at an angle to the upper portion, a pair of spaced side surfaces, and a pair of spaced lower surfaces extending from the rear surface lower portion which are substantially coplanar. The damper pocket lower surfaces are provided by a first flange extending laterally inward from one of the side surfaces and a second flange extending laterally inward from the other side surface, where a retainer pin extends through and is connected to at least one of the first and second flanges so as to trap the bar-shaped damping member within the damper pocket.

In accordance with a second aspect of the present invention, a rotor assembly for a gas turbine engine is disclosed as including a rotor disk having means for receiving a root portion of a rotor blade arranged on the outer circumference of the rotor disk, at least one rotor blade received by the receiving means of the rotor disk, and means for rotatably supporting the rotor disk for rotation about an axis. The rotor blade includes a root portion, a platform portion connected to the root portion and having a damper pocket formed therein, an airfoil portion connected to the platform portion, a generally bar-shaped damping member loosely arranged in the damper pocket having at least one scrubbing surface, and means for retaining the bar-shaped damping member in the damper pocket.

BRIEF DESCRIPTION OF THE DRAWING

While the specification concludes with claims particularly pointing out and distinctly claiming the present invention, it is believed the same will be better understood from the following description taken in conjunction with the accompanying drawing in which:

DETAILED DESCRIPTION OF THE INVENTION

Figure 1:
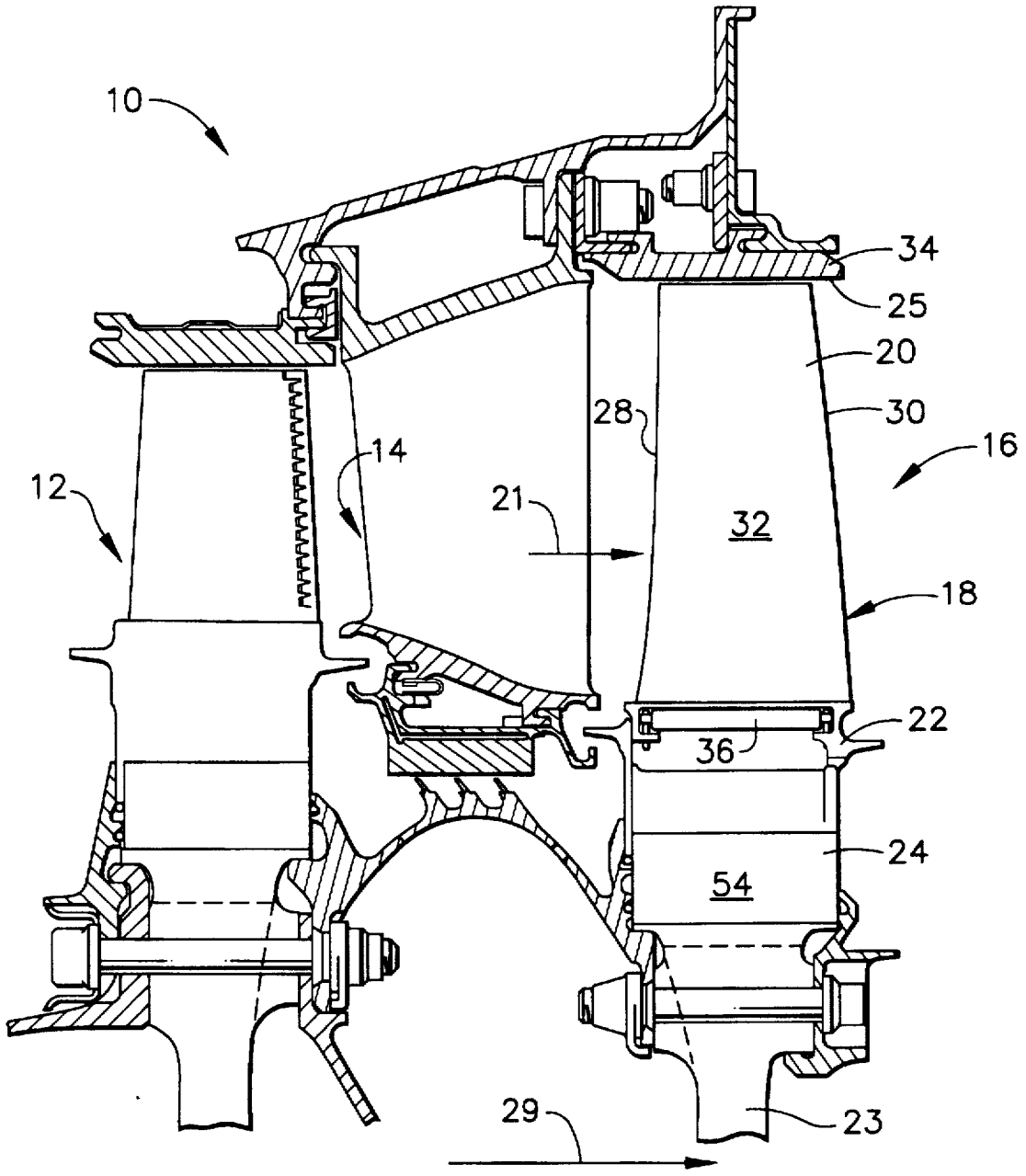
FIG. 1 is a partial cross-sectional view of a high pressure turbine in a gas turbine engine, where a bar damper for the second stage rotor is shown as being retained within the damper pocket thereof in accordance with the present invention.

Referring now to the drawings in detail, wherein identical numerals indicate the same elements throughout the figures, FIG. 1 partially depicts a turbine 10 for a gas turbine engine. It will be seen that turbine 10 includes a first stage rotor 12, a stator 14, and a second stage rotor 16. While the present invention will be described with respect to a turbine blade 18 of second stage rotor 16, it will be understood that it may just as easily be applied to any number of rotor blades of any stage in either a turbine or a compressor of a gas turbine engine.

As seen in FIG. 1, turbine blade 18 includes an airfoil portion 20, a platform portion 22, and a root (or dovetail) portion 24. A plurality of such blades are circumferentially distributed on the periphery of a rotor disk 23, where root portion 24 of each turbine blade 18 slides into a complementarily configured axially disposed recess (not shown) in rotor disk 23 and secures turbine blade 18 to rotor disk 23.

Airfoil portion 20 of each turbine blade 18 extends radially outwardly into an annular flow passageway 21 defined between radially outwardly facing cylindrically segmented surfaces 26 of platforms 22 and a radially inwardly facing surface 25 of a tip shroud 34. Rotor 16 is journalled for rotation about a horizontal axis 29 (see FIG. 1) such that airfoil portion 20 of turbine blades 18 rotate in annular flow passageway 21 in response to axial flow of gas from a combustor (not shown) through passageway 21. It will be understood that each airfoil portion 20 has a rounded leading edge 28 directed toward the gas flow, a trailing edge 30, a concave pressure surface 32, and a convex suction surface (not shown).

Figure 2:
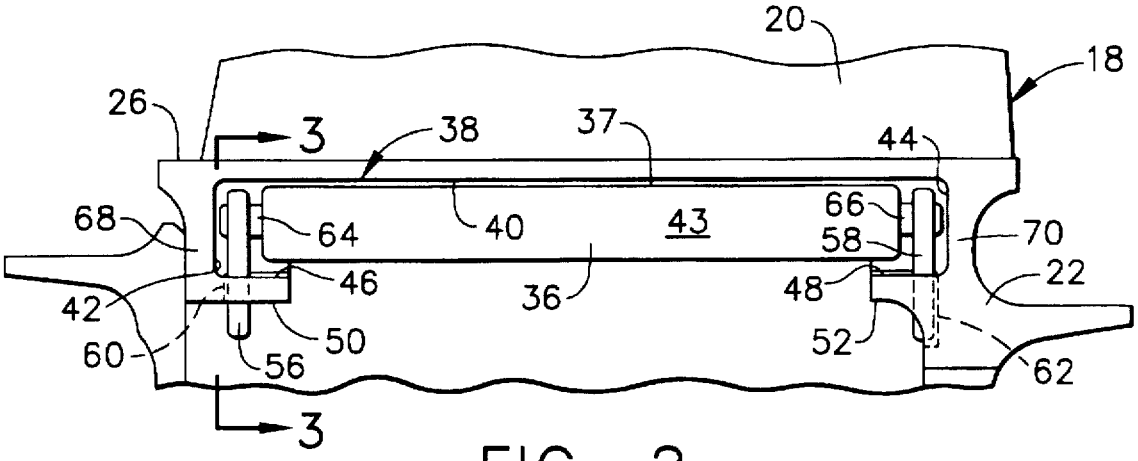
FIG. 2 is an enlarged view of the platform portion for a turbine blade of the second stage rotor depicted in FIG. 1.
Figure 3:
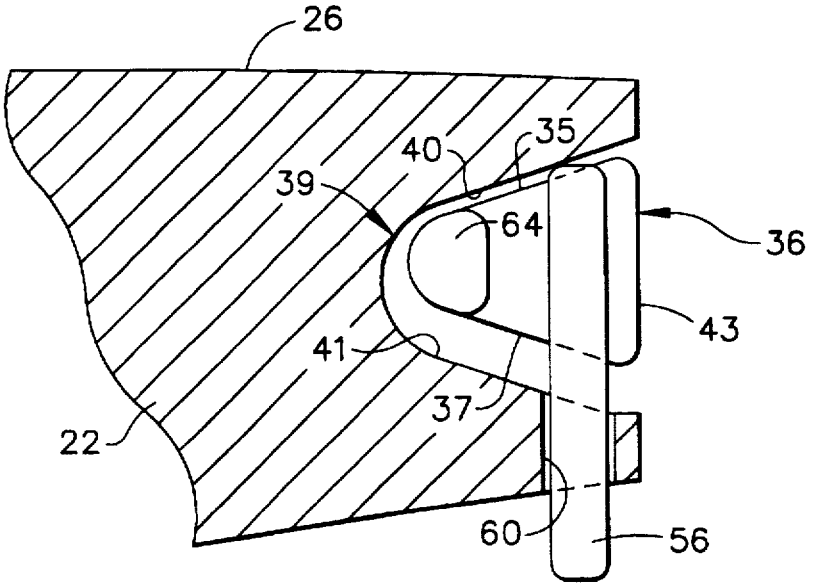
FIG. 3 is a cross-sectional view of the turbine blade platform portion along line 3—3 of FIG. 2.
Figure 4:
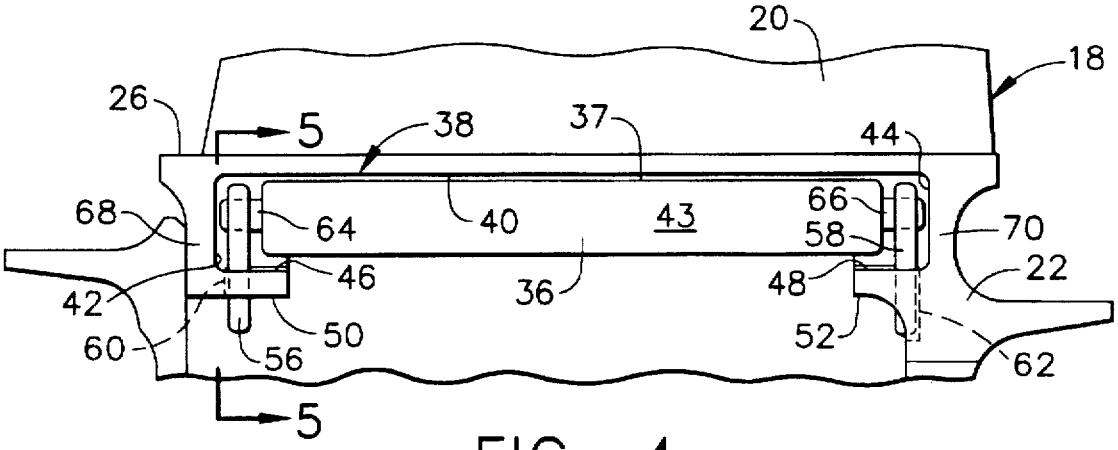
FIG. 4 is an enlarged view of the platform portion for a turbine blade of the second stage rotor depicted in FIG. 1, where a bar damper for the second stage rotor is shown as being retained within the damper pocket thereof in accordance with a second embodiment of the invention.
Figure 5:
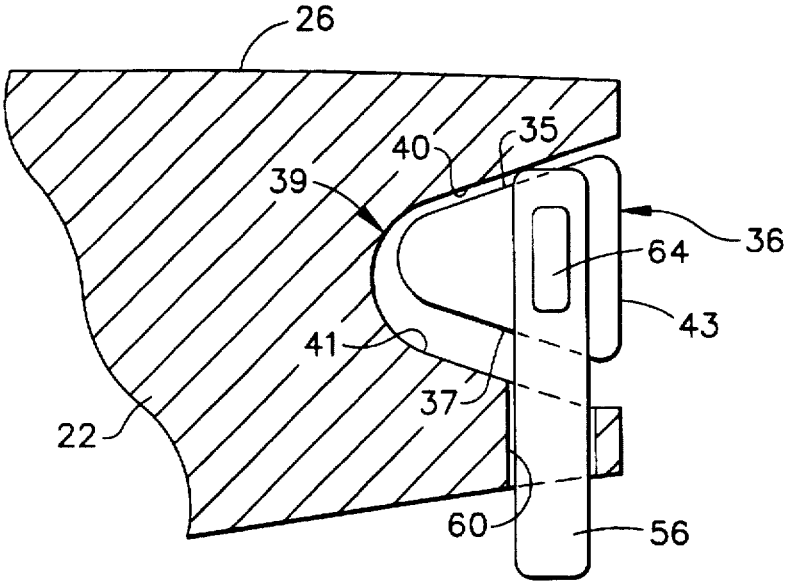
FIG. 5 is a view of the turbine blade platform portion depicted in along lines 5—5 in FIG. 4.

The entire rotor blade is preferably an integrally formed cast-and-machined member. Airfoil portion 20 of turbine blade 18 extends radially outwardly from platform radially outer surface 26 to tip shroud 34 with respect to turbine blade 18. When exposed to the gas flow, airfoil portion 20 is subjected to both flexural and torsional stresses. Accordingly, a damper 36 is provided within a damper pocket 38 formed in platform portion 22 below platform radially outer surface 26. It is best seen in FIGS. 2 and 3 that damper pocket 38 is substantially triangular in cross-section and defined by a rear surface 39 having an upper portion 40 and a lower portion 41 at an angle to upper portion 40, a pair of spaced side surfaces 42 and 44, and a pair of spaced lower surfaces 46 and 48 extending from lower portion 41 of rear surface 39. It will be noted that lower surfaces 46 and 48 of damper pocket 38 are provided by the upper surfaces of a pair of substantially coplanar flanges 50 and 52 which extend inward from side surfaces 42 and 44, respectively, and are located a distance below outwardly facing surface 26 of platform portion 22.

A number of damper designs have been employed previously within the art, as detailed above. While the primary function of such a damper is to provide one or more surfaces which may be scrubbed against by platform portion 22, and thereby create friction to deter the stresses imposed upon turbine blade 18, it is preferred that such damper also function as an axial platform seal to reduce the ingestion of hot flowpath gases into a shank cavity region 54 within root portion 24 of turbine blade 18. This results in a reduction of disk post metal temperatures and an improvement in disk creep capability. One such damper which is able to perform both functions is a bar-type damper having an elongated design that extends substantially across the entire width of damper pocket 38, as shown in FIG. 2.

With respect to at least certain applications, it has become necessary for turbine blades 18 of rotor 16 to be removed during assembly and disassembly of an adjacent nozzle assembly. Because bar-type dampers 36 have heretofore been positioned loosely within damper pocket 38, the possibility of a bar damper 36 falling out of its respective damper pocket 38 and into the core engine has been significant. Thus, in order to prevent potential foreign object damage to the gas turbine engine, it has become necessary to provide an appropriate means for retaining bar damper 36 within damper pocket 38. Although other damper designs have included retention devices, as seen for the wedge-shaped dampers disclosed in U.S. Pat. Nos. 5,302,085 and 5,261,790, they are not applicable to bar damper 36 utilized herein. It is further preferred that the retention means provided not interfere with airflow around and within platform portion 22 and root portion 24 in order to be consistent with current design practice.

As seen in FIG. 3, bar damper 36 is designed in terms of size and shape to fit within damper pocket 38 and therefore preferably has a substantially triangular cross-section in which a first surface 35 is substantially parallel to upper portion 40 of damper pocket rear surface 39, a second surface 37 is substantially parallel to lower portion 41 of damper pocket rear surface 39, and a third surface 43 is substantially parallel to a front opening of damper pocket 38. It will further be seen that a pair of members 64 and 66 preferably extend from opposite ends of bar damper 36, such members being located toward the rear of bar damper 36 away from third surface 43 and having a smaller cross-section than bar damper 36.

In accordance with the present invention, a pair of retainer pins 56 and 58 are provided which extend through holes 60 and 62, respectively, of interior platform flanges 50 and 52. It will be understood that retainer pins 56 and 58 are preferably permanently connected to interior platform flanges 50 and 52 (such as by welding or the like). Retainer pins 56 and 58 are therefore positioned so as to be adjacent end members 64 and 66, respectively, of bar damper 36 where they function to retain bar damper 36 loosely within damper pocket 38. It will be noted that this arrangement permits bar damper 36 to move (or be displaced) within damper pocket 38. Additionally, bar damper 36 is allowed to rotate to some extent so that first surface 35 thereof is properly seated against upper portion 40 of damper pocket rear surface 39 during rotation of rotor 16 (due to the centrifugal forces imposed thereon). In this way, first surface 35 may be used as a scrubbing surface by platform portion 22 of turbine blade 18.

Having shown and described the preferred embodiment of the present invention, further adaptations of the retention means for a bar damper in a rotor blade can be accomplished by appropriate modifications by one of ordinary skill in the art without departing from the scope of the invention. One option would be to have retainer pins 56 and 58 extend through openings in end members 64 and 66 instead of being positioned adjacent thereto, where bar damper 36 is allowed to slide up and down retainer pins 56 and 58. Another option would be to connect retainer pins 56 and 58 to bar damper end members 64 and 66 instead of to interior platform flanges 50 and 52, where bar damper 36 is permitted to move in damper pocket 38 via movement of retainer pins 56 and 58 within holes 60 and 62 of interior platform flanges 50 and 52. While it is possible that retainer pins 56 and 58 could be coupled to bar damper 36 through side walls 68 and 70 of platform portion 22 to retain bar damper 36 within damper pocket 38, this alternative is deemed less desirable since it would require an elongated slot in side walls 68 and 70 to allow vertical movement of bar damper 36 and retainer pins 56 and 58 and such a configuration would have the negative effect of obstructing air flow around platform portion 22.

What is claimed is:

1. A rotor blade for a rotor of a gas turbine engine having an axis of rotation, comprising:

(a) a root portion;

(b) a platform portion connected to said root portion and having a damper pocket formed therein, said damper pocket having a substantially triangular cross-section and further comprising:

(1) a rear surface having an upper portion and a lower portion at an angle to said lower portion;

(2) a pair of spaced side surfaces; and (3) a pair of spaced, substantially coplanar lower surfaces extending from said rear surface lower portion, said damper pocket lower surfaces being provided by a first flange extending laterally inward from one of said side surfaces and a second flange extending laterally inward from the other of said side surfaces;

(c) an airfoil portion connected to said platform portion;

(d) a generally bar-shaped damping member loosely arranged in said damper pocket having at least one scrubbing surface; and (e) a first retainer pin extending through and being connected to at least one of said first and second flanges so as to retain said bar-shaped damping member in said damper pocket.

2. The rotor blade of claim 1, wherein said bar-shaped damping member is slidably displaceable within said damper pocket.

3. The rotor blade of claim 2, wherein said bar-shaped damping member is rotatable within said damper pocket during rotation of said rotor.

4. The rotor blade of claim 1, further comprising a second retainer pin so that said first and second retainer pins extend through and are connected to said first and second flanges, respectively.

5. The rotor blade of claim 4, wherein said retainer pins are positioned adjacent a pair of end members extending from said bar-shaped damping member.

6. The rotor blade of claim 4, wherein said retainer pins are positioned through a pair of end members extending from said bar-shaped damping member.

7. The rotor blade of claim 1, wherein said rotor is located within a compressor of said gas turbine engine.

8. The rotor blade of claim 1, wherein said rotor is located within a turbine of said gas turbine engine.

9. A rotor assembly for a gas turbine engine having an axis of rotation, comprising:

(a) a root portion;

(b) a platform portion connected to said root portion and having a damper pocket formed therein, said damper pocket having a substantially triangular cross-section and further comprising:

(1) a rear surface having an upper portion and a lower portion at an angle to said lower portion;

(2) a pair of spaced side surfaces; and (3) a pair of spaced, substantially coplanar lower surfaces extending from said rear surface lower portion, said damper pocket lower surfaces being provided by a first flange extending laterally inward from one of said side surfaces and a second flange extending laterally inward from the other of said side surfaces;

(c) an airfoil portion connected to said platform portion;

(d) a generally bar-shaped damping member loosely arranged in said damper pocket having at least one scrubbing surface; and (e) a retainer pin extending through at least one of said first and second flanges and being connected to an end member extending from said bar-shaped damping member so as to retain said bar-shaped member within said damper pocket.

10. A rotor assembly for a gas turbine engine, comprising:

(a) a rotor disk including means for receiving a root portion of a rotor blade arranged on the outer circumference of said rotor disk;

(b) at least one rotor blade, comprising:

(1) a root portion received by said receiving means of said rotor disk;

(2) a platform portion connected to said root portion and having a damper pocket formed therein, said damper pocket having a substantially triangular cross-section and including:

(a) a rear surface having an upper portion and a lower portion at an angle to said upper portion;

(b) a pair of spaced side surfaces; and (c) a pair of spaced, substantially coplanar lower surfaces extending from said rear surface lower portion, said damper pocket lower surfaces being provided by a first flange extending laterally inward from one of said side surfaces and a second flange extending laterally inward from the other of said side surfaces;

(3) an airfoil portion connected to said platform portion;

(4) a generally bar-shaped damping member loosely arranged in said damper pocket having at least one scrubbing surface; and (5) first and second retainer pins extending through and being connected to said first and second flanges, respectively, wherein said first and second retainer pins are positioned adjacent opposite ends of said bar-shaped damping member so as to retain said bar-shaped damping member within said damper pocket.

11. A rotor assembly for a gas turbine engine, comprising:

(a) a rotor disk including means for receiving a root portion of a rotor blade arranged on the outer circumference of said rotor disk;

(b) at least one rotor blade, comprising:

(1) a root portion received by said receiving means of said rotor disk;

(2) a platform portion connected to said root portion and having a damper pocket formed therein, said damper pocket having a substantially triangular cross-section and including:

(a) a rear surface having an upper portion and a lower portion at an angle to said upper portion;

(b) a pair of spaced side surfaces; and (c) a pair of spaced, substantially coplanar lower surfaces extending from said rear surface lower portion, said damper pocket lower surfaces being provided by a first flange extending laterally inward from one of said side surfaces and a second flange extending laterally inward from the other of said side surfaces;

(3) an airfoil portion connected to said platform portion;

(4) a generally bar-shaped damping member loosely arranged in said damper pocket having at least one scrubbing surface; and (5) first and second retainer pins extending through and being connected to said first and second flanges, respectively, wherein said first and second retainer pins are positioned to extend through opposite ends of said bar-shaped damping member so as to retain said bar-shaped damping member within said damper pocket.

12. A rotor assembly for a gas turbine engine, comprising:

(a) a rotor disk including means for receiving a root portion of a rotor blade arranged on the outer circumference of said rotor disk;

(b) at least one rotor blade, comprising:

(1) a root portion received by said receiving means of said rotor disk;

(2) a platform portion connected to said root portion and having a damper pocket formed therein, said damper pocket having a substantially triangular cross-section and including:

(a) a rear surface having an upper portion and a lower portion at an angle to said upper portion;

(b) a pair of spaced side surfaces; and (c) a pair of spaced, substantially coplanar lower surfaces extending from said rear surface lower portion, said damper pocket lower surfaces being provided by a first flange extending laterally inward from one of said side surfaces and a second flange extending laterally inward from the other of said side surfaces;

(3) an airfoil portion connected to said platform portion;

(4) a generally bar-shaped damping member loosely arranged in said damper pocket having at least one scrubbing surface; and (5) first and second retainer pins extending through and being connected to said first and second flanges, respectively, and being connected to opposite ends of said bar-shaped damping member so as to retain said bar-shaped damping member within said damper pocket.

* * * * *